United States Patent [19]

Vecchiarelli

[11] 4,173,879

[45] Nov. 13, 1979

[54] METHOD AND APPARATUS FOR FORMING A METAL STRIP

[75] Inventor: Francis Vecchiarelli, River Edge, N.J.

[73] Assignee: Hunter Douglas International N.V., Netherlands

[21] Appl. No.: 865,395

[22] Filed: Dec. 29, 1977

[51] Int. Cl.[2] ..... B21D 5/08

[52] U.S. Cl. ..... 72/179; 72/181

[58] Field of Search ..... 72/179, 181, 182, 131, 72/133, 428; 29/24.5

[56] References Cited

U.S. PATENT DOCUMENTS

| | | | |
|---|---|---|---|
| 469,763 | 3/1892 | Williams | 72/179 |
| 495,147 | 4/1893 | Barraclough et al. | 72/179 X |
| 1,588,817 | 6/1926 | Smith | 72/179 X |
| 2,262,550 | 11/1941 | Hunter | 72/179 X |
| 3,344,641 | 10/1967 | Pomory | 72/179 X |
| 3,555,864 | 1/1971 | Wegner | 29/24.5 X |

FOREIGN PATENT DOCUMENTS

| | | | |
|---|---|---|---|
| 149549 | 5/1937 | Austria | 72/179 |

*Primary Examiner*—Milton S. Mehr

*Attorney, Agent, or Firm*—Pennie & Edmonds

[57] ABSTRACT

A method and apparatus for forming a metal strip into a shape having a transverse concave, convex bow, for example, for forming slats for venetian blinds. The strip material is fed into the nip of a pair of forming rolls having complementary concave and convex peripheral surfaces, to provide the bow. In order to ensure that the resulting bowed strip is formed without any twist, the strip is fed along a substantially straight path upstream of the forming rolls, and the direction of this straight path is adjustable in a plane passing through the nip and parallel to the axes of the forming rolls.

22 Claims, 4 Drawing Figures

METHOD AND APPARATUS FOR FORMING A METAL STRIP

The present invention relates to a method and apparatus for forming a metal strip to a shape having a transverse concave-convex bow. Such a bowed strip may be used, for example, as a slat for a venetian blind.

Various proposals have been made for forming the concave-convex bow in a slat of material and one such proposal is described in British Patent specification No. 780,169. The strip is fed between a first pair of formimg rolls provided with a peripheral forming surface, one of the rolls having a convex forming surface and the other a concave forming surface of complementary shape. The strip is then fed through a second set of similar rolls. In order to guide the strip, it is guided to the first set of forming rolls by a pair of preforming rolls, which also have complementary concave and convex shapes. After passing the first forming rolls the strip is guided by a further pair of so-called "preforming" rolls and a similar set is provided downstream of the second pair of forming rolls.

Such a structure is generally satisfactory provided that the strip material is of a very high quality and has no internal stresses. However, it is not readily possible to obtain really high quality strips without increasing the cost of production significantly. Further, it has been conventional, in fact, to make the strip of aluminium and to paint this aluminium strip prior to the forming into the concave-convex bow. To reduce the risk of paint damage, the number of mechanical contact points should be kept as low as possible.

In recent years, therefore, in practice it has been proposed to dispense with one of the pairs of forming rolls and with the final so-called preforming rolls so that there is a preforming roll upstream of the single pair of forming rolls and a similar "preforming" roll downstream thereof.

However, these known constructions cannot cope with a serious problem arising when the strip material is not of the highest quality. In such cases the bowed strip is often twisted along its length. Thus, when the strip is cut into individual slat lengths for a venetian blind, these slats are twisted, that is to say their bowed cross-section is twisted from one end to the other, which makes the slats unacceptable.

It is an object of the present invention to provide an improved method and apparatus for forming strip material into a shape having a transverse concave-convex bow.

It is a further object of the present invention to provide an attachment for an existing machine which overcomes the difficulties of the formation of twist in the bowed strip.

It is a still further object of the present invention to provide an improved apparatus for forming venetian blind slats.

It is now proposed, according to the present invention, to provide a method of forming a thin metal strip into a shape having a transverse concave-convex bow, said method comprising providing a supply of metal strip, feeding the strip to the nip of a pair of rolls rotatable about parallel axes and having complementary male and female peripheral forming surfaces, guiding the strip over a substantially straight path upstream of the nip of said forming rolls, and adjusting the relative feed direction of the strip during said guiding in a plane passing through the nip parallel to the axes.

While it is contemplated that the feed direction of the strip may be fixed and the rolls may be moved, in a preferred arrangement according to the invention the rolls will be fixed in position and the adjustment will involve adjusting the feed direction of the strip itself.

It has been found that with such a method it is possible to control the feeding of the strip in the straight path upstream of the forming rolls in such a way as to substantially remove the twist in the finished product.

The problem of twist, which is of extreme importance for products, such as venetian blind slats, occurs often with forming methods using flat as well as preformed thin metal strip of less than high quality. By "preformed strip" is meant herein, a strip which has been subjected to a forming step, giving the strip a cross-sectional form which is an intermediate form between the original and final form. The principle on which the invention is based, is that twist should not be corrected after final forming of the strip, but should be prevented from occurring by corrective steps being taken just before the final forming step.

One of the important factors in twist arising is that the pressure of the form rolls distorts the strip before it enters the contact area between the forming rolls and this can have a harmful effect if there is homogeneous and/or non-uniform residual stress. If with thin and/or narrow strip, such stress is not compensated for before and/or during the main forming step, torsional effects generally known as "twist" will occur that will stay and cannot effectively be dealt with after the main forming step has been concluded.

Having appreciated these facts, the invention is able to solve the problem in that twist occurring in thin metal strip after roll-forming can be controlled, and thus substantially eliminated, by off-setting the centre line of forming pressure in the plane of feed or in a plane parallel to said plane of feed, said off-setting in the case of homogeneous residual stress being parallel off-setting and in the case of non-uniform residual stress being angular off-setting. When both types of residual stress are present in the strip material it may be necessary to apply both types of correction.

It has been found that by angularly offsetting the centre of pressure of the strip as it passes through the forming rolls, it is possible to counteract any non-uniform residual stress in the strip. The present invention, contemplates the possibility of guiding the strip over a substantially straight path upstream of the nip of the forming rolls and adjusting the angular feed direction of the strip during the guiding in a plane which passes through the nip and parallel to the axes.

It is also proposed, according to the present invention, to adjust the lateral position of the strip during the guiding in the plane which passes through the nip and parallel to the axes. This has the effect of moving the centre of pressure parallel to the axes of the strip to counteract any residual homogenous stress in the strip. Of course if the strip has no residual stress, then this adjustment is such as to ensure that the strip passes dead centre through the nip of the forming rolls.

It is further possible to control the position of the strip in a direction which is perpendicular to the plane which passes through the nip and is parallel to the axes.

In a preferred embodiment, the strip is guided by means of an elongate guide member having a through-going slot therein, of a length and width closely to guide the longitudinal edges of the thin metal strip over a substantial length. This provides an accurate control of the strip along a straight path upstream of the nip. It is also contemplated that instead of having such a guide member, the guiding of the strip upstream of the nip could be effected by passing the strip between a series of guide elements, for example a number of rolls which are disposed in an array which abut the edges of the strip and control its movement along a straight path. This array of rolls could then be moved together, to provide any displacement which is necessary.

The invention further provides apparatus for forming a metal strip into a shape having a transverse concave-convex bow, the apparatus comprising a pair of forming rolls rotatable about parallel axes which define a nip, complementary male and female convex and concave peripheral forming surfaces on said rolls, feed means for feeding strips to be formed through the nip of said forming rolls, guide means for guiding said strip over a substantially straight path upstream of said nip of the forming rolls and means for adjusting the relative direction of the straight path with respect to said rolls in a plane passing through the nip and parallel to the axes.

In an advantageous construction, a mounting plate is provided on which said guide means and said means for adjusting are mounted, the said means for adjusting determine the position of the guide means relative to the mounting plate in a plane parallel to the axes of the forming rolls. The position adjusting means may comprise two adjusting members spaced apart from one another in the direction of feed of the strip, each one of said adjusting members being operable independently of the other, whereby operation of one of the adjusting members effects angular adjustment and both of the adjusting members effects lateral parallel adjustment of the guide means.

The adjustment members preferably comprise a pair of spaced apart screwed rods supported on said mounting plate and passing through said guide means, a nut fitted onto each of the passed through ends of the rods, pressure springs being situated between the guide means and the mounting plates forcing the guide members from the mounting plates, whereby rotation of one of the nuts effects said angular displacement of the guide means and of both of said nuts effects lateral parallel adjustment thereof.

Desirably the adjusting members comprise a pair of spaced apart screwed rods supported on said mounting plate and passing through said guide means, a nut threaded into each of the passed through-ends of said rods, pressure springs situated between said guide means and said mounting plate forcing said guide members from said mounting plate, whereby rotation of one of said nuts effects said angular adjustment of said guide means and of both of said nuts can effect said lateral, parallel adjustment thereof.

The invention also contemplates a guide assembly which is mountable on an existing apparatus for forming a thin metal strip into a shape having a transverse concave-convex bow, which apparatus includes a pair of rotatable forming rolls with complementary male and female convex and concave peripheral forming surfaces defining a nip, the guide assembly serving to guide the strip into the nip and comprising a mounting plate mountable on the apparatus, a guide member defining a throughgoing slot of a length and width to guide the longitudinal edges of the metal strip over a substantial length and means for adjusting the position of the longitudinal axes of the longer sides of the elongate guide member relative to said mounting plate.

Finally, the invention contemplates apparatus for forming slats for venetian blinds from thin strip material, said apparatus comprising means for carrying a supply of strip metal material, a pair of forming rolls rotatable about parallel axes to define a nip, complementary male and female convex and concave peripheral forming surfaces on the rolls, feed means for feeding strips from the supply through the nip of the forming rolls, guide means for guiding the strip over a substantially straight path upstream of the nip of the forming rolls, means for adjusting the direction of the straight path in a plane passing through said nip parallel to said axes, guide rolls downstream of the forming rolls, a slat support, stop means positionable relative to the slat support to stop strip material fed along said slat support from the forming rolls and guide rollers, cutting and punching means for cutting preselected lengths of slat from the strip material and punching holes in the slat and discharge means discharging slats thus formed from the slat support.

Advantageously, the guide rolls which are located downstream from the forming rolls are themselves provided with complementary male and female convex and concave surfaces.

Desirably the axial position of said guide rollers is adjustable, e.g. by some form of screw adjustment, so that the strip can be encouraged to pass accurately through the centre of the elongate through-going slot of the guide member. This has the advantage that it prevents wear of the guide member, particularly at the ends thereof, and also provided a further fine adjustment enabling the substantial elimination of all twist in the slats.

Preferably the spacing between these rolls is arranged to be slightly greater than the thickness of the strip, so that the guide rolls to a certain extent flatten slightly the bow which has been formed by the forming rolls. This has the advantage of relieving edge pressure on the strip so any tendency to overstress the edges of the strip is reduced and the inherent tendency to uneven stresses is much less, improving even further the opportunity to obtain straight slats on the forming rolls.

In order that the present invention may more readily be understood, the following description of the best mode for putting the invention into effect, is given, reference being made to the accompanying drawings, in which.

Figure 1:
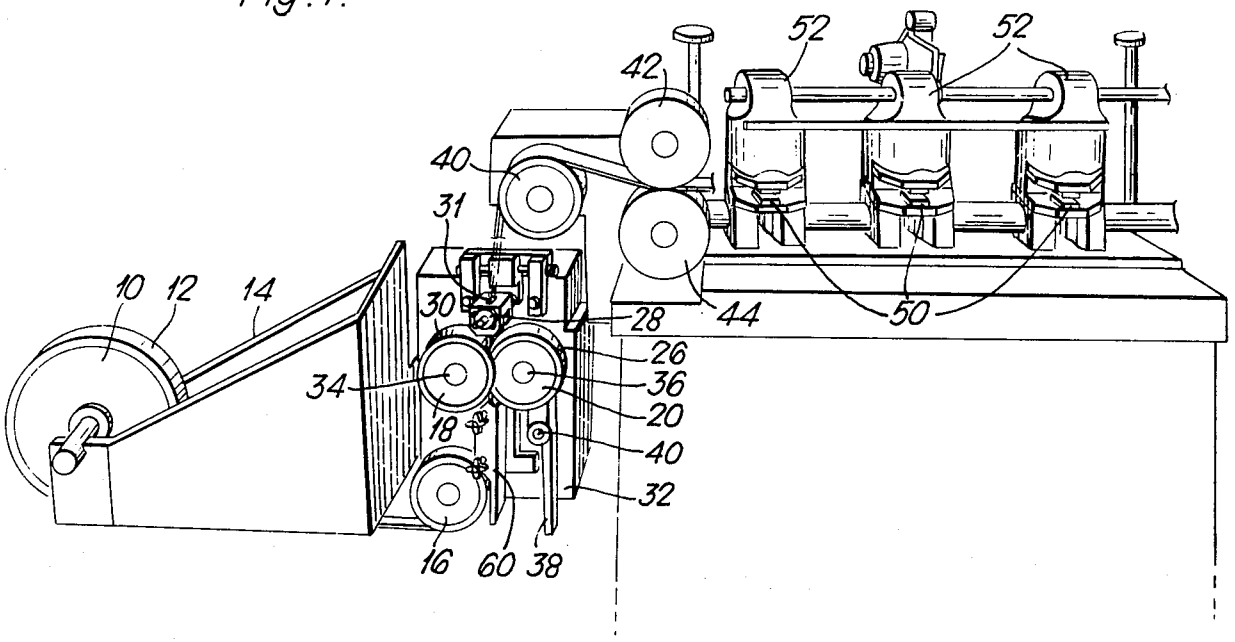
FIG. 1 is a perspective view of one embodiment of apparatus according to the invention, for making venetian blind slats.

The apparatus illustrated in FIG. 1 comprises a supply roll 10 of strip material 12 mounted on a supply support 14 which is mounted by means (not shown) on the frame of the apparatus. Located to the right of the support 14, in FIG. 1, is an apparatus according to the invention for forming a transverse concave bow in the strip material 12.

This apparatus includes a first guide roller 16, a pair of forming rolls 18, 20 and a pair of second guiding rollers 22, 24. The forming roll 20 is formed with a male convex peripheral surface 26 and the forming roll 18 is provided with a female concave peripheral surface 30 which is of complementary shape to the convex surface 26. The two rollers 22 and 24 are also of concave and convex form respectively, and are mounted on parallel axes on an inverted channel-shaped bracket 21. This bracket is mounted on a base member 32 by means of a support plate 23, carried by base member 22, by a threaded rod 25 and by a dowel 25A. Positioned between bracket 21 and support plate 23 and surrounding rod 25 is a compression spring 27. Threaded onto the rod 25 is an adjustment nut 28, a collar 29 being positioned between this nut and bracket 21. Rotation of the nut causes movement of the bracket 21 in a direction parallel to the axes of guiding rollers 22, 24. This, in turn, causes adjustment of the guiding rollers 22, 24 in an axial direction, relative to the forming rolls. A slot 31 is provided in the web of the channel section bracket 21 for the passage of the strip material.

Roller 18 is mounted on a base member 32 by means of a shaft 34, so that its axis is fixed. On the other hand, the roller 20 is mounted on a shaft 36 which is itself located at the upper end of a lever 38 which is pivoted at 40 to the base 32. This enables the spacing between the axes of the rollers to be altered to the desired value for the thickness of the particular strip which is being treated.

The strip, after passing through the guide rollers 22, 24 is thereafter caused to pass over a further guide roller 40 and thence onto a pair of discharge rollers 42, 44. These discharge rollers are associated with a flat support 50, shown in three parts, associated with three punches 52, viz two slot punches and a cutting punch therebetween. A stop member together with the punches, the discharge rollers and slat support form part of a slat forming and dispensing unit of which only the cutting and punching part is shown in the drawing, is positionable to stop the strip 12 which is fed forward by the discharge rollers 42 at a particular location.

Such a slat forming and dispensing unit, with its component parts, does not form part of the invention and various types are known, for example, that shown in U.S. Pat. No. 3,766,815 (Edixhoven).

Figure 2:
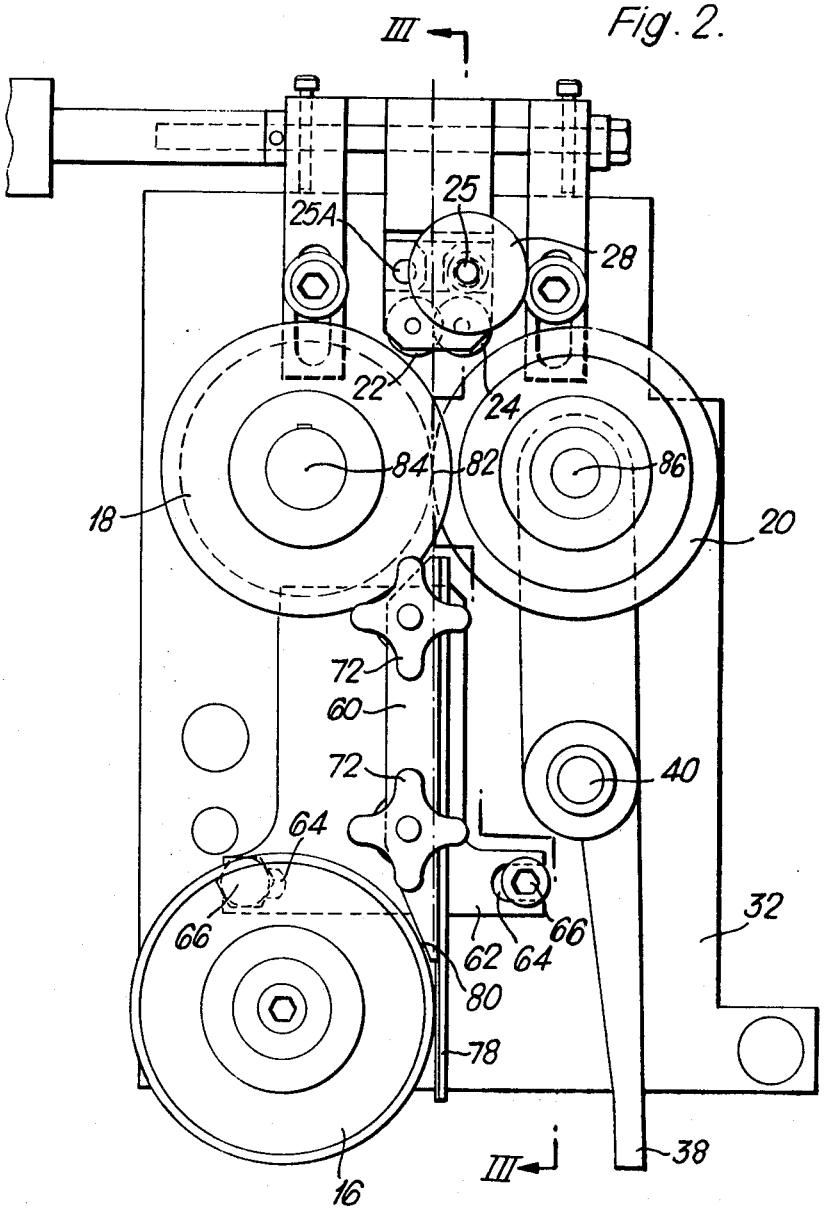
FIG. 2 is an enlarged side elevation of the apparatus for forming the strip material with a transverse concave-convex bow, used in the apparatus of FIG. 1.
Figure 3:
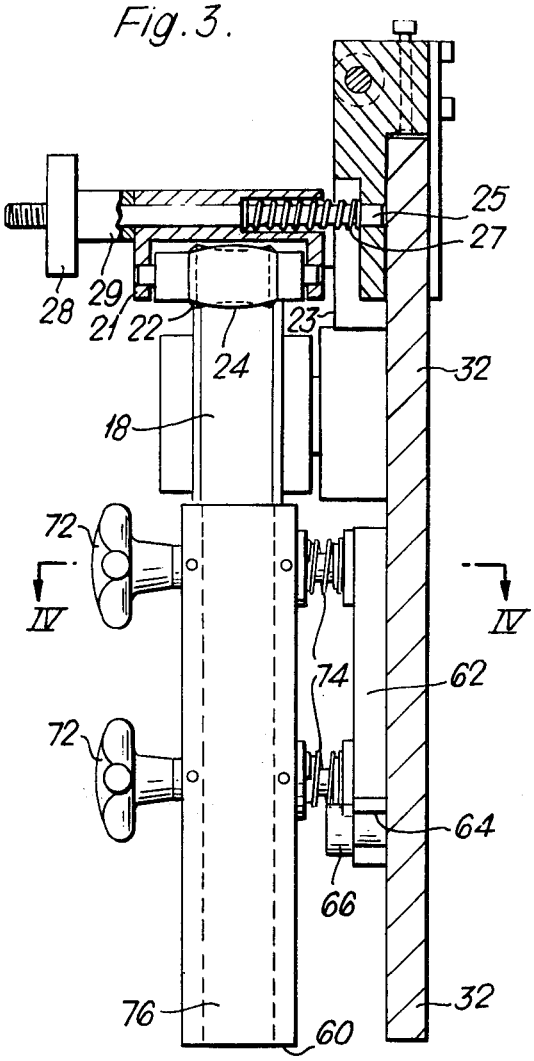
FIG. 3 is a section taken along the line III—III of FIG. 2.
Figure 4:
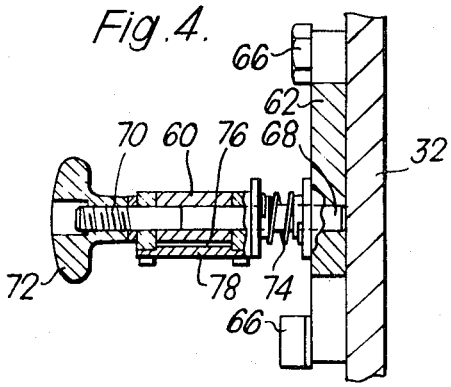
FIG. 4 is a section taken along the line IV—IV of FIG. 3.

In FIG. 1 there can also be seen a guide member 60 which is placed immediately below, that is to say upstream of the forming rollers 18, 20. This portion of the apparatus is shown in much greater detail in FIG. 2 and also in FIGS. 3 and 4. In FIG. 2 the base member 32 can be seen as well as the first guide roller 16, and the forming rollers 18, 20. The actual mounting of the roller 20 is illustrated with greater clarity in FIG. 2.

A mounting plate 62 which is provided with wide slots 64 is mounted on the base member 32 by means of bolts 66, the diameter of which is less than the size of the slots 64, so that the position of the mounting plate can be altered both horizontally and vertically as seen in FIG. 2. The guide member 60 is mounted on the mounting plate 62 by means of rods 68 (FIGS. 3 and 4) which are affixed to the mounting plate and pass through the guide member 60 and have threaded end portions 70 threadably engaged by nuts 72. A compression spring 74 is located between the mounting plates 62 and the adjacent end of the guide member 60. It will be seen in particular from FIGS. 3 and 4 that the elongate guide member 60 is provided with a rectangular cross-section guide slot 76 which extends along the length of the guide member and is formed by a recess in the guide member and by a cover plate 78 which extends downwardly beyond the tapered end 80 (FIGS. 2) adjacent the guiding roll 16.

Referring to FIG. 2, it will be seen that the section line III-III includes three parallel parts. The first part, at the upper part of FIG. 2, extends through the nip 82 formed between the forming rolls 18 and 20. The central portion of section line III-III is slightly offset to the right thereof, and to the right of the guide member 60, while the third portion is offset a little more to the right of the righthandmost bolt 66. The upper part of the section line III-III, therefore represents a plane which is through the nip of the rolls 18, 20 and parallel to the axes 84, 86 thereof.

It will be appreciated that operation of both of the nuts 72 to the same extent will move the guide member bodily and parallel to itself in the plane passing through the nip of the rolls and parallel to the axes 84, 86. On the other hand, operation of one only of these, or differential operation of the two, will cause there to be angular displacement of the slot 76 in this plane, so that the slot 76 will be inclined from the vertical as viewed in FIG. 3.

In operation, the strip material is fed from the suply 10 over roller 16, through the rectangular guide slot 76 in the guide member 60 to a location close to the nip 82 between the forming rolls 18, 20 and thence through the rolls 22, 24 around roller 40 to the discharge rollers 42. These rollers feed the strip material against a stop (not shown) which temporarily stops the end of the strip. While this happens, the strip material which is continuously fed on by the forming rolls 18, 20 forms a vertical loop above roller 40. The slatting, punching and cutting devices punch holes in the strip for the venetian blind and cut off a slit length. When that has been done further discharge rolls (not shown) feed the slats out to the right as viewed in FIG. 1 and the operation continues as before.

It will be appreciated that the elongate guide member 60, with the slot, serves to guide the strip material along a substantially straight path upstream of the forming rolls 18, 20. By experiment or by any technical method, it can be observed whether the slats which are discharged from the apparatus have any twist in them. If they do have twists, this can be corrected by operating one or both of the nuts 72, depending on the character of the twist.

For parallel adjustment, that is for correction of homogeneous residual stress in the strip material, both nuts will be operated in the same direction to the same extent. For angular adjustment for correction of non-uniform residual stress in the strip one of the nuts is operated, preferably lower nut 72. It can also prove necessary to adjust both nuts unequally or even in opposite directions depending on the type and extent of twist. When the desired straight slats are produced the machine is allowed to continue to operate.

It is also possible to adjust the axial position of the guiding rollers 22, 24 by means of nut 28 as explained above. This adjustment is made for the slat to be accurately centred in the slot 76 which prevents wear of the guide member particularly at the ends thereof. It also gives fine adjustment enabling substantial elimination of all twist in the slats.

It will be appreciated that by providing the adjustments which have been mentioned above, it is possible even with less than the highest quality of strip material, whether flat or preformed and/or coated or painted, to produce slats which have substantially no twists therein. It may be that the twist along the length of the strip coming off the supply alters in the course of time and further adjustment will be necessary. However, these adjustments can quickly be made by the operator as soon as he notices anything going wrong.

The adjustment provided by the bolts 66 allows the guide member 60 to be centred accurately to feed the strip correctly into the nip of the forming rolls.

We claim:

1. A method of forming a thin metal strip into a non-twisted slat with a shape having a transverse concave-convex bow, which metal strip may have stress therein tending to create twist in the finished slat, said method comprising the steps of:

(a) providing a supply of metal strip;

(b) feeding the strip to the nip of a pair of rolls rotatable about parallel axes and having complementary male and female peripheral forming surfaces;

(c) guiding the strip over a substantially straight path upstream of the nip of said forming rolls; and (d) compensating for any twist inducing stress in said strip by adjusting the relative feed direction of the strip during said guiding with respect to said rolls in a plane passing through the nip and parallel to said axes.

2. The method set forth in claim 1, wherein the position of said rolls is fixed and the step of adjusting said relative feed direction involves adjusting the feed direction of the strip itself.

3. The method set forth in claim 2, wherein the step of adjusting the feed direction involves adjusting the angular position of said strip during said guiding in said plane passing through said nip and parallel to said axes.

4. The method set forth in claim 2, wherein the step of adjusting feed direction involves adjusting the lateral position of said strip during said guiding in said plane passing through said nip and parallel to said axes.

5. The method set forth in claim 2, and further comprising the step of adjusting the angular position of said strip during said guiding perpendicular to said plane passing through said nip and parallel to said axes.

6. The method set forth in claim 2, wherein the strip is guided by means of an elongate guide member having a throughgoing slot therein, of a length and width to closely guide the longitudinal edges of the thin metal strip over a substantial length.

7. Apparatus for forming a thin metal strip into a shape having a transverse concave-convex bow, which strip may have stress therein tending to produce twist in the finished shape, said apparatus comprising, in combination:

(a) a pair of forming rolls rotatable about parallel axes to define a nip;

(b) complementary male and female convex and concave peripheral forming surfaces on said rolls;

(c) feed means for feeding strip to be formed through the nip of said forming rolls;

(d) guide means for guiding said strip over a substantially straight path upstream of said nip of said forming rolls; and (e) means for compensating for any twist inducing stress in said strip including means for accurately adjusting the relative direction of said straight path with respect to said rolls in a plane passing through the nip and parallel to the axes.

8. Apparatus as claimed in claim 7, wherein said adjusting means includes means for adjusting said guide means.

9. Apparatus as claimed in claim 8 and further comprising a mounting plate on which said guide means and said means for adjusting are mounted, and said means for adjusting determining the position of the guide means relative to said mounting plate in a plane parallel to the axes of the forming rolls.

10. Apparatus as claimed in claim 9, wherein said means for adjusting the position of the guide means includes two adjusting members spaced apart from one another in the direction of feed of the strip, each one of said adjusting members being operable independently of the other, whereby operation of one of said adjusting members effects angular adjustment; and operation of both of said adjusting members can effect lateral, parallel adjustment of said guide means.

11. Apparatus as claimed in claim 10, wherein said adjusting members comprise a pair of spaced apart threaded rods supported on said mounting plate and passing through said guide means, a nut threaded onto each of the passed-through ends of said rods, pressure springs situated between said guide means and said mounting plate forcing said guide members from said mounting plate, whereby rotation of one of said nuts effects said angular adjustment of said guide means and of both of said nuts can effect said lateral, parallel adjustmemt thereof.

12. Apparatus as claimed in claim 9 and further comprising means for adjusting the direction of said straight path in a plane perpendicular to the plane through the nip and parallel to said axes.

13. Apparatus as claimed in claim 12, and further comprising a mounting plate on which said guide means is mounted, the means for adjusting said straight path in a plane perpendicular to the plane through the nip and parallel to said axes including means for adjusting the position of said mounting plate relative to said rolls.

14. Apparatus as claimed in claim 13, wherein said means for adjusting the position of said mounting plate comprises slots in said mounting plate and clamping means passing through said slots with clearance, effective to allow said mounting plate and said guide means to be moved into another position.

15. Apparatus as claimed in claim 14, wherein said guide means comprises an elongate guide member defining a throughgoing guide slot of a length and of a width to closely guide the longitudinal edges of the thin metal strip over a substantial length.

16. Apparatus as claimed in claim 8 and further comprising guide rollers arranged downstream of said forming rolls on axes parallel to said forming rolls.

17. Apparatus as claimed in claim 16 and further comprising means to adjust the axial position of said guide rollers.

18. A guide assembly for an apparatus for forming a thin metal strip into a non-twisted shape having a transverse concave-convex bow, which metal strip may have stress therein tending to create twist in the finished shape, and including a pair of rotatable forming rolls with complementary male and female convex and concave peripheral forming surfaces defining a nip, said assembly serving to guide said strip into said nip and comprising:

a mounting plate mountable on said apparatus; an elongate guide member defining a throughgoing slot of a length and width to closely guide the longitudinal edges of the metal strip over a substantial length and means for compensating for any twist inducing stress in said metal strip including means for accurately adjusting the position of the longitudinal axes of the longer sides of said elongate guide member effective to move the central axis of the metal strip guided by said plate relative to said mounting plate.

19. A guide assembly as claimed in claim 18, wherein said adjusting means comprises a pair of threaded rods, spaced apart from one another in the direction of feed of said thin metal strip, said threaded rods being supported on said mounting plate and passing through said guide member and nuts threaded onto said threaded rods.

20. Apparatus for forming slats for venetian blinds from thin strip metal material, said apparatus comprising, in combination:

(a) means for carrying a supply of strip metal material;

(b) a pair of forming rolls located about parallel axes to define a nip;

(c) complementary male and female convex and concave peripheral forming surfaces on said rolls; (d) feed means for feeding strip material from said supply through said nip of said forming rolls;

(e) guide means for guiding said strip over a substantially straight path upstream of said nip of said forming rolls;

(f) means for compensating for any twist inducing stress in said strip material including means for adjusting the direction of said straight path in a plane passing through said nip parallel to said axes;

(g) guide rollers downstream of said forming rolls;

(h) a slat support;

(i) stop means positionable relative to said slat support effective to stop strip material fed along said slat support from said forming rolls and guide rollers;

(j) cutting and punching means for cutting of preselected lengths of slat from said strip material and for punching holes in said slats; and (k) discharge means for discharging slats thus formed from said slat support.

21. Apparatus as claimed in claim 20, and further comprising a mounting plate attached to said apparatus, and wherein said guide means comprises an elongate guide member defining a throughgoing slot of a length and width to closely guide the longitudinal edges of the thin metal strip over a substantial length, and said means for adjusting the direction of said straight path comprises two adjusting members affixed to said mounting plate and engaging said guide means at two connecting points spaced from one another in the direction of the feed of the thin metal strip, each adjusting member being capable of independently varying the distance between the relevant connecting point and the mounting plate.

22. Apparatus as claimed in claim 21, wherein said mounting plate is removably and adjustably mounted on said apparatus.

* * * * *

UNITED STATES PATENT AND TRADEMARK OFFICE

CERTIFICATE OF CORRECTION

PATENT NO. : 4173879

DATED : November 13, 1979

INVENTOR(S) : Francis Vecchiarelli

It is certified that error appears in the above-identified patent and that said Letters Patent are hereby corrected as shown below:

Assignee: Hunter Douglas International N.V.
Netherlands Antilles

Column 2, Line 66 "embodiment" should read "arrangement"

Column 4, Line 33 "provided" should read "provides"

Column 6, Line 2 (Figs. 2) should read (Figure 2)

Column 6, Line 24 "suply" should read "supply"

Column 6, Line 35 "slit" should read "slat"

Signed and Sealed this

*Thirteenth* Day of *May 1980*

[SEAL]

*Attest:*

SIDNEY A. DIAMOND

*Attesting Officer*

*Commissioner of Patents and Trademarks*